US010317847B2

(12) United States Patent
Shirao

(10) Patent No.: US 10,317,847 B2
(45) Date of Patent: Jun. 11, 2019

(54) ELECTRONIC TIMEPIECE

(71) Applicant: Seiko Epson Corporation, Tokyo (JP)

(72) Inventor: Akira Shirao, Shiojiri (JP)

(73) Assignee: Seiko Epson Corporation (JP)

( * ) Notice: Subject to any disclaimer, the term of this patent is extended or adjusted under 35 U.S.C. 154(b) by 147 days.

(21) Appl. No.: 15/448,941

(22) Filed: Mar. 3, 2017

(65) Prior Publication Data

US 2017/0277135 A1 Sep. 28, 2017

(30) Foreign Application Priority Data

Mar. 23, 2016 (JP) ..... 2016-057826

(51) Int. Cl.
*G04G 3/00* (2006.01)
*G04G 5/00* (2013.01)

(52) U.S. Cl.
CPC ..... *G04G 3/00* (2013.01); *G04G 5/00* (2013.01)

(58) Field of Classification Search
CPC ..... G04G 3/00; G04G 5/00; G04C 3/14
See application file for complete search history.

(56) References Cited

U.S. PATENT DOCUMENTS 6,163,126 A * 12/2000 Kojima ..... G04C 3/14 318/685
6,476,579 B1 11/2002 Akahane et al.

FOREIGN PATENT DOCUMENTS

| | | | |
|---|---|---|---|
| JP | 07-043480 | A | 2/1995 |
| JP | 07-151872 | A | 6/1995 |
| JP | 10-332852 | A | 12/1998 |
| JP | 2003-333896 | A | 11/2003 |
| JP | 2013-255393 | A | 12/2013 |
| JP | 2014-102112 | A | 6/2014 |

* cited by examiner

*Primary Examiner* — Edwin A. Leon
*Assistant Examiner* — Jason M Collins
(74) *Attorney, Agent, or Firm* — Harness, Dickey & Pierce, P.L.C.

(57) ABSTRACT

An electronic timepiece includes: a latch unit that latches and outputs specification data designating a specification in accordance with a latch signal; a signal output unit that outputs one of a plurality of driving signals including driving pulses at different periods based on the specification data output from the latch unit; a driving unit that drives a motor based on the driving signal output from the signal output unit; and a control unit that generates the latch signal so that the latch signal has at least an active level at a timing before generation of each driving pulse in the driving signal with a shortest period of the driving pulse among the plurality of driving signals.

5 Claims, 5 Drawing Sheets

ELECTRONIC TIMEPIECE

BACKGROUND

1. Technical Field

The present invention relates to an electronic timepiece.

2. Related Art

For example, various technologies for sharing driving devices that rotate indicators such as second hands or minute hands have been proposed between a plurality of types of electronic timepieces with different specifications in the related art. For example, JP-A-2014-102112 discloses a configuration in which one of a plurality of driving pulses generated at different periods is selected according to data designating the specification of a device. In a technology of JP-A-2014-102112, a specification corresponding to a reduction in power voltage is selected in a case in which the power voltage is reduced up to a power voltage less than a predetermined value.

Incidentally, for example, data designating a specification of an electronic timepiece is abruptly changed to content different from appropriate content corresponding to an actual specification, for example, due to chattering of a power voltage caused by an impact at the time of falling of an electronic timepiece or an instantaneous variation in a voltage caused by static electricity. Accordingly, an operation appropriate for an electronic timepiece is hindered. As a result, there is a possibility of a user feeling a sense of discomfort.

SUMMARY

An advantage of some aspects of the invention is to provide a technology for quickly correcting content appropriate for specification data changed abruptly.

An electronic timepiece according to a preferred aspect of the invention includes: a latch unit that latches and outputs specification data designating a specification in accordance with a latch signal; a signal output unit that outputs one of a plurality of driving signals including driving pulses at different periods based on the specification data output from the latch unit; a driving unit that drives a motor based on the driving signal output from the signal output unit; and a control unit that generates the latch signal so that the latch signal has at least an active level at a timing before generation of each driving pulse of the driving signal with a shortest period of the driving pulse among the plurality of driving signals. In the aspect of the invention, the latch signal is generated so that the latch signal has at least the active level at the timing before generation of each driving pulse of the driving signal with the shortest period of the driving pulse among the plurality of driving signals. Accordingly, when the specification data output from the latch unit abruptly varies, it is possible to quickly correct the specification data to appropriate content.

The electronic timepiece according to the preferred aspect of the invention may further include a storage unit that stores the specification data. The latch unit may latch the specification data read from the storage unit. The electronic timepiece according to another aspect of the invention may further include a setting terminal with which one of a plurality of voltages is supplied. The latch unit may latch and output the specification data according to the voltage of the setting terminal in accordance with the latch signal.

In the preferred aspect of the invention, the driving pulse may include a plurality of sub-pulses. The control unit may set the latch signal to the active level during a period of the sub-pulses occurring in succession. In the foregoing aspect of the invention, the latch signal is set to the active level during the period of the sub-pulses included in the driving pulse. That is, the latch unit latches the specification data within the period of the driving pulse. Accordingly, even in a case in which the specification data output from the latch unit abruptly varies within the period of the driving pulses, the specification data can quickly be corrected without waiting for an immediately subsequent driving pulse.

In the preferred aspect of the invention, the control unit may generate the latch signal so that the latch signal has the active level at the timing before the generation of the driving pulses of each of the plurality of driving signals. In the foregoing aspect of the invention, the latch signal is generated so that the latch signal has the active level at the timing before the generation of the driving pulses of each of the plurality of driving signals. Accordingly, the above-described advantage of quickly correcting the specification data output by the latch unit is particularly noticeable.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
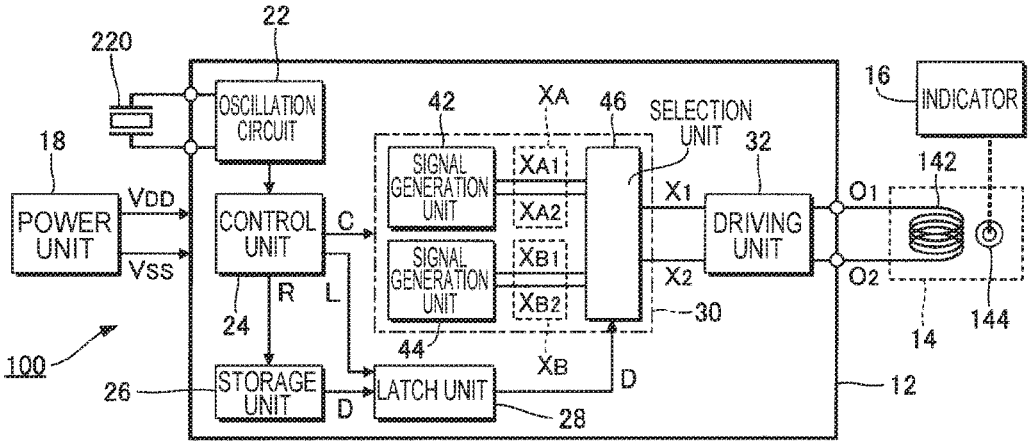
FIG. 1 is a diagram illustrating the configuration of an electronic timepiece according to a first embodiment of the invention.

FIG. 1 is a diagram illustrating an example of the configuration of an electronic timepiece 100 according to a first embodiment of the invention. As exemplified in FIG. 1, the electronic timepiece 100 according to the first embodiment is an electronic device that includes a driving device 12, a motor 14, an indicator 16, and a power unit 18. A wristwatch mounted on a wrist of a user is a typical example of the electronic timepiece 100 and any specific form of the electronic timepiece 100 is used.

The indicator 16 is a second hand or a minute hand used to indicate a time. The motor 14 rotates the indicator 16. The motor 14 according to the first embodiment is a stepping motor including a coil 142 and a rotor 144. When a driving pulse O1 and a driving pulse O2 are supplied to the coil 142, the rotor 144 is rotated. Then, the rotation of the rotor 144 is transmitted to the indicator 16 via a wheel structure (not illustrated) including gears to rotate the indicator 16. The power unit 18 is configured to include, for example, a battery and supplies a power voltage VDD and a ground voltage VSS to the driving device 12.

The driving device 12 is an electronic circuit that drives the motor 14 when power is fed from the power unit 18. For example, the driving device 12 is mounted in the form of, for example, an integrated circuit (IC) chip on the electronic timepiece 100. The driving device 12 according to the first embodiment can be used in a plurality of kinds of electronic timepieces 100 with different specifications. As exemplified in FIG. 1, the driving device 12 according to the first embodiment includes an oscillation circuit 22, a control unit 24, a storage unit 26, a latch unit 28, a signal output unit 30, and a driving unit 32. The elements of the driving device 12 can also be distributed into a plurality of IC chips.

The oscillation circuit 22 generates an oscillation signal with a predetermined frequency using an oscillation source 220 such as a crystal oscillator. The control unit 24 is configured to include a divider circuit that divides the oscillation signal generated by the oscillation circuit 22 and generates various signals (for example, a read signal R, a latch signal L, and a criterion signal C) that define a timing of an operation of each component of the driving device 12.

The storage unit 26 is a nonvolatile memory configured with, for example, a semiconductor memory. The storage unit 26 according to the first embodiment stores data D designating the specification of the electronic timepiece 100 on which the driving device 12 is mounted (hereinafter referred to as "specification data"). For example, the specification data D with content according to the specification of the electronic timepiece 100 is stored in the storage unit 26 before shipment of the electronic timepiece 100. The storage unit 26 according to the first embodiment outputs the specification data D according to the read signal R generated by the control unit 24.

The latch unit 28 latches the specification data D retained in the storage unit 26 and outputs the specification data D to the signal output unit 30. Specifically, the latch unit 28 imports the specification data D from the storage unit 26 at a timing defined by the latch signal L generated by the control unit 24 and retains an output of the specification data D to the signal output unit 30.

The signal output unit 30 includes a signal generation unit 42, a signal generation unit 44, and a selection unit 46. The criterion signal C generated by the control unit 24 is supplied to the signal generation units 42 and 44. The criterion signal C is a clock signal with a predetermined period. The signal generation unit 42 generates a driving signal XA based on the criterion signal C. The signal generation unit 44 generates a driving signal XB based on the criterion signal C. The driving signal XA includes driving signals XA1 and XA2. The driving signal XB includes driving signals XB1 and XB2.

Figure 2:
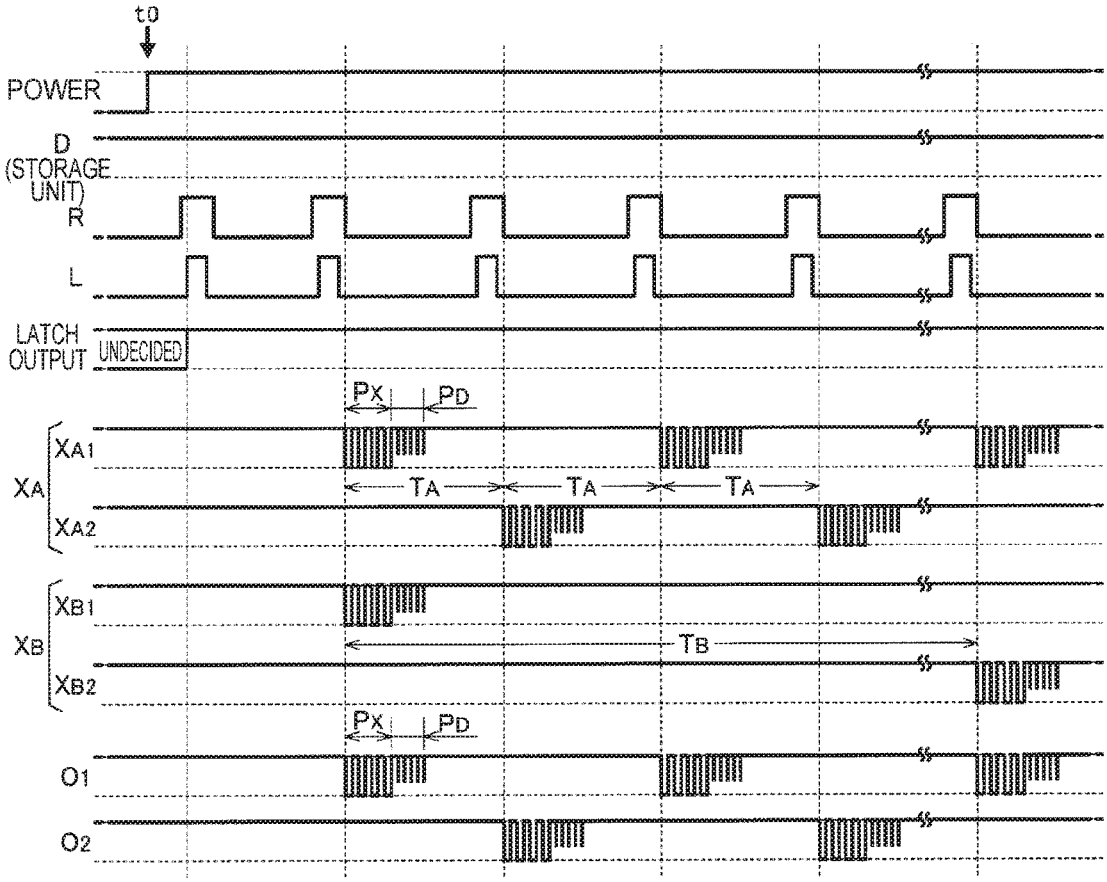
FIG. 2 is a diagram illustrating waveforms of signals used in the electronic timepiece.

FIG. 2 is a diagram illustrating waveforms of signals used in the electronic timepiece 100. As exemplified in FIG. 2, the driving signals XA1, XA2, XB1, and XB2 each include a driving pulse PX. The driving pulse PX is a pulse used for the driving unit 32 to drive the motor 14. In the first embodiment, the driving pulse PX with a waveform in which a plurality of sub-pulses are arranged in a pectinate shape at intervals is exemplified. A detection pulse PD is set immediately after the driving pulse PX. The detection pulse PD has a pulse waveform with a pectinate shape as in the driving pulse PX and is used to detect rotation of the rotor 144. The detection of rotation of the detection pulse PD is disclosed in JP-A-2003-333896 or JP-A-2013-255393.

As exemplified in FIG. 2, the plurality of driving pulses PX are set at a period 2TA in each of the driving signals XA1 and XA2. A position of the driving pulse PX on the time axis differs between the driving signals XA1 and XA2. That is, in the driving signals XA including the driving signals XA1 and XA2, the driving pulse PX is set at the period TA. On the other hand, in each of the driving signals XB1 and XB2, the plurality of driving pulses PX are set at a period 2TB. A position of the driving pulse PX on the time axis differs between the driving signals XB1 and XB2. That is, in the driving signals XB including the driving signals XB1 and XB2, the plurality of driving pulses PX are set at a period TB. As understood from FIG. 2, the period TB is longer than the period TA. Specifically, the period TB is set at an integer multiple of the period TA. For example, the period TA is set to 1 second and the period TB is set to 20 seconds.

The selection unit 46 in FIG. 1 selectively outputs one of the driving signals XA (XA1 and XA2) generated by the signal generation unit 42 and the driving signals XB (XB1 and XB2) generated by the signal generation unit 44 according to the specification data D output from the latch unit 28. The specification data D according to the first embodiment designates a first specification for driving the indicator 16 (for example, a second hand) at the period TA and a second specification for driving the indicator 16 (for example, a minute hand) at the period TB. In the electronic timepiece 100 in which the specification data D designates the first specification, the selection unit 46 selects the driving signal XA in which the driving pulse PX is set at the period TA as the driving signals X (X1 and X2). On the other hand, in the electronic timepiece 100 in which the specification data D designates the second specification, the selection unit 46 selects the driving signal XB in which the driving pulse PX is set at the period TB as the driving signals X (X1 and X2). As exemplified in FIG. 2, a high level of the specification data D means the first specification and a low level of the specification data D means the second specification. In FIG. 2, a case in which the first specification for driving the indicator 16 at the period TA is designated by the specification data D is exemplified for convenience.

The driving signal X selected by the selection unit 46 is supplied to the driving unit 32. Specifically, one of a pair of driving signals XA1 and XA2 and a pair of driving signals XB1 and XB2 is supplied as the driving signals X1 and X2 to the driving unit 32. As understood from the foregoing description, the signal output unit 30 according to the first embodiment functions as an element that outputs one of the plurality of driving signals (the driving signal XA with the period TA and the driving signal XB with the period TB) in which the periods of the driving pulses PX are different.

The driving unit 32 drives the motor 14 based on the driving signal X output from the signal output unit 30. Specifically, the driving unit 32 supplies the coil 142 of the motor 14 with the driving pulse O1 according to each driving pulse PX of the driving signal X1 and the driving pulse O2 according to each driving pulse PX of the driving signal X2. In the electronic timepiece 100 in which the specification data D designates the first specification, as exemplified in FIG. 2, the driving pulse O1 and the driving pulse O2 are alternately supplied to the coil 142 at each period TA (for example, 1 second). Accordingly, the indicator 16 (for example, a second hand) is driven sequentially at the period TA. On the other hand, in the electronic timepiece 100 in which the specification data D designates the second specification, the driving pulse O1 and the driving pulse O2 are alternately supplied to the coil 142 at each period TB (for example, 20 seconds).

As exemplified in FIG. 2, the control unit 24 sets the read signal R and the latch signal L at an active level (a high level in the example of FIG. 2) immediately after power is fed to the electronic timepiece 100 (time point t0). Through the foregoing operation, the specification data D is output from the storage unit 26 and the specification data D is latched by the latch unit 28. That is, whether the driving signal XA or the driving signal XB is output to the driving unit 32 is decided according to the specification data D immediately after power is fed to the electronic timepiece 100.

Further, the control unit 24 according to the first embodiment controls the storage unit 26 and the latch unit 28 such that the specification data D is output by the storage unit 26 and the specification data D is latched by the latch unit 28 at a timing before generation of each driving pulse PX of the driving signal XA. Specifically, as exemplified in FIG. 2, the control unit 24 sets the read signal R and the latch signal L to an active level at a timing before the generation of each of the plurality of driving pulses PX of the driving signal XA. That is, the read signal R and the latch signal L are set to the active level sequentially at the same period TA as the driving signal XA. As understood from the foregoing operation, in the first embodiment, the latch of the specification data D by the latch unit 28 is repeated periodically not only immediately after feeding of power but also in a subsequent normal operation state.

Incidentally, the power voltage VDD instantaneously varies (chatters) due to disturbance such as an impact at the time of falling of the electronic timepiece 100 or static electricity in some cases. When the instantaneous variation of the power voltage VDD occurs, there is a possibility of content of the specification data D output from the latch unit 28 to the signal output unit 30 being abruptly changed. In the first embodiment, since the latch of the specification data D is repeated a plurality of times by the latch unit 28, the specification data D abruptly varying due to the variation in the power voltage VDD can quickly be corrected to appropriate content, as will be described in detail below.

Figure 3:
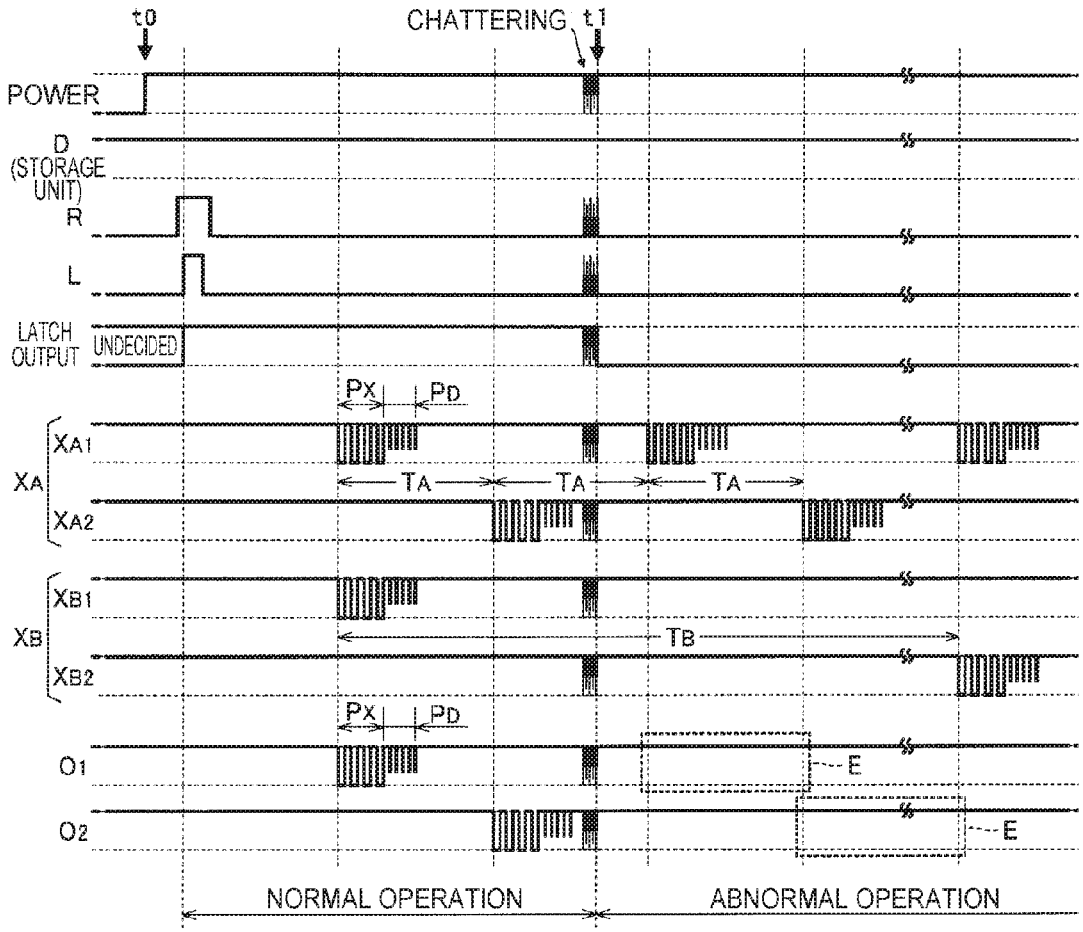
FIG. 3 is a diagram illustrating a problem of a comparative example.

FIG. 3 is a diagram illustrating an operation in a configuration (hereinafter referred to as a "comparative example") in which a latch unit 28 latches specification data D only immediately after power is fed (time point t0). In FIG. 3, a case in which the specification data D designates the first specification (a case in which the specification data D is set to a high level) is assumed as in FIG. 2.

As exemplified in FIG. 3, when an instantaneous variation in the power voltage VDD occurs, the level of the specification data D output from the latch unit 28 to the signal output unit 30 can be reversed from a high level corresponding to the first specification to a low level meaning the second specification at time point t1. Accordingly, the driving signal XB in which the driving pulse PX is set at the period TB transitions to a state output from the signal output unit 30 to the driving unit 32. As a result, the indicator 16 is driven at the period TB. In the above state, the driving pulses (O1 and O2) which are normally output to the motor 14 are not output in a section E of FIG. 3. That is, an appropriate operation of rotating the indicator 16 at the period TA is hindered, and thus there is a possibility of a user feeling a sense of discomfort.

Figure 4:
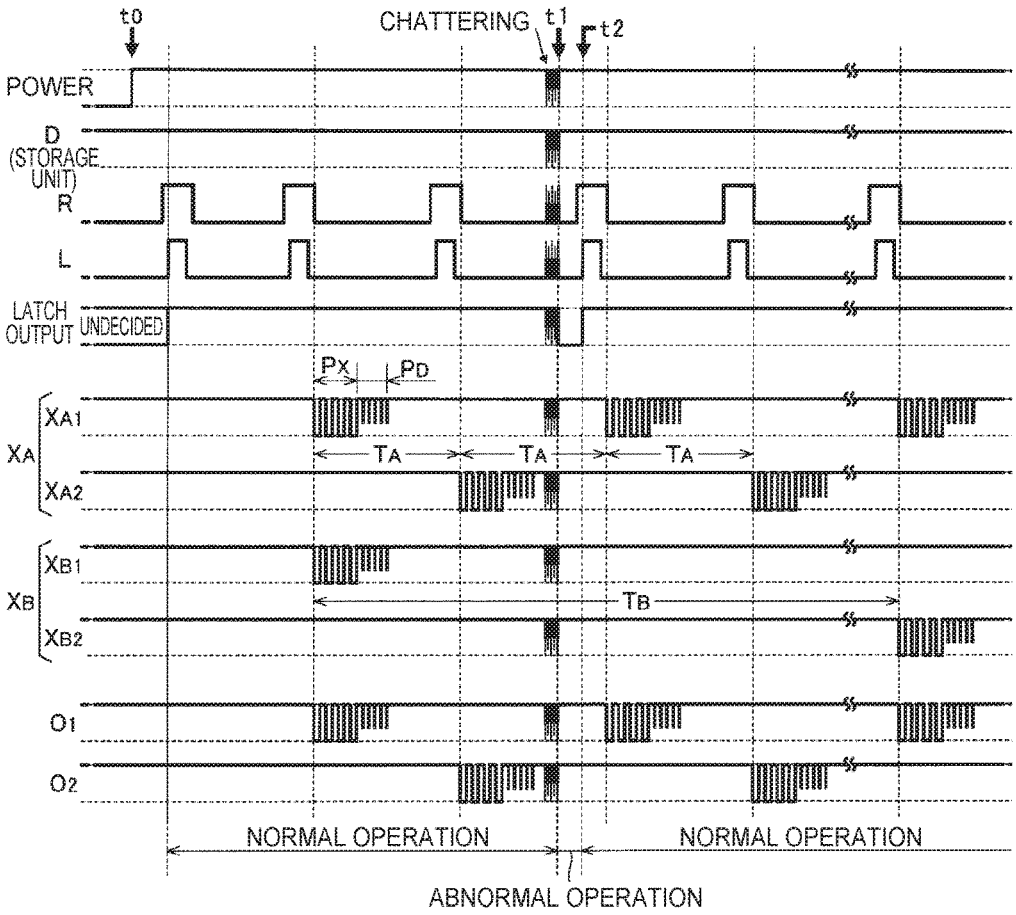
FIG. 4 is a diagram illustrating advantages according to a first embodiment.

FIG. 4 is a diagram illustrating an operation in a case in which a power voltage VDD abruptly varies in the configuration according to the first embodiment. As exemplified in FIG. 4, even in the first embodiment, the level of the specification data D to be output to the signal output unit 30 is reversed from the high level corresponding to the original specification to the low level at time point t1. In the first embodiment, however, immediately after time point t1 of the variation in the power voltage VDD, the latch signal L is set to the active level at time point t2 before generation of each driving pulse PX of the driving signal XA. Accordingly, the specification data D retained in the storage unit 26 is latched again, and thus the level of the specification data D to be output to the signal output unit 30 is corrected to the high level corresponding to the original specification of the electronic timepiece 100. That is, according to the first embodiment, it is possible to quickly correct the specification data D abruptly varying due to the variation in the power voltage VDD to the appropriate content, compared to the comparative example of FIG. 3. In the first embodiment, particularly, the latch signal L is set to the active level before generation of each driving pulse PX of the driving signal XA with a short period between the driving signals XA and XB. Accordingly, the above-described advantage of quickly correcting the abruptly varying specification data D is particularly noticeable, compared to the configuration in which the latch signal L is set to the active level before generation of each driving pulse PX of the driving signal XB.

Second Embodiment

A second embodiment of the invention will be described. Reference numerals used to describe the first embodiment are given to the same elements as those of the first embodiment in operational effects and functions in each aspect to be exemplified below, and the detailed description thereof will be appropriately omitted.

Figure 5:
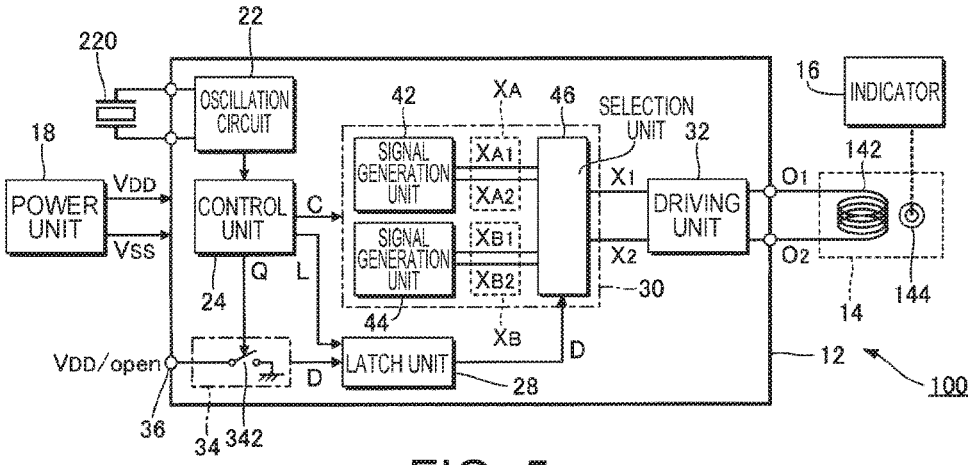
FIG. 5 is a diagram illustrating the configuration of an electronic timepiece according to a second embodiment.

FIG. 5 is a diagram illustrating an example of the configuration of an electronic timepiece 100 according to the second embodiment. As exemplified in FIG. 5, the electronic timepiece 100 according to the second embodiment is configured such that the storage unit 26 of the first embodiment is substituted with a pull-down circuit 34 in FIG. 5. The pull-down circuit 34 is a circuit that outputs the specification data D according to a voltage of a setting terminal 36 and includes a switch 342 that is disposed between the setting terminal 36 and a ground wire (ground voltage VSS) and controls electric connection between the setting terminal 36 and the ground wire. The switch 342 is configured with, for example, an n-channel type transistor and is set to either an on state or an off state according to a control signal Q supplied from the control unit 24.

The setting terminal 36 is a terminal that designates a specification of the electronic timepiece 100. For example, a bonding option terminal of an IC chip is appropriately used as the setting terminal 36. A voltage state of the setting terminal 36 is selected according to the specification of the electronic timepiece 100. Specifically, the setting terminal 36 is set to the power voltage VDD in the electronic timepiece 100 of the first specification in which the indicator 16 is driven at the period TA. The setting terminal 36 is set to an open state in the electronic timepiece 100 of the second specification in which the indicator 16 is driven at the period TB.

Figure 6:
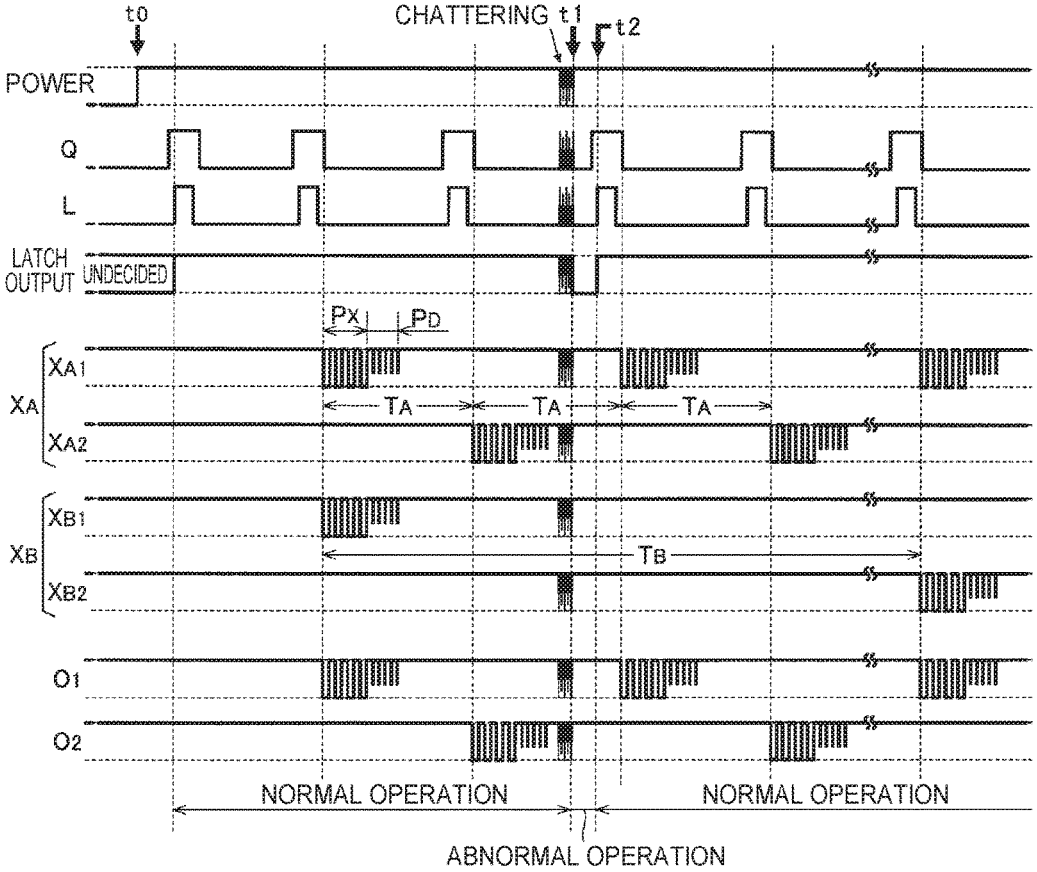
FIG. 6 is a diagram illustrating waveforms of signals used in the electronic timepiece according to the second embodiment.

FIG. 6 is a diagram illustrating waveforms of signals used in the electronic timepiece 100 according to the second embodiment. As exemplified in FIG. 6, the control signal Q of the second embodiment has the same waveform as the read signal R of the first embodiment. That is, the control signal Q and the latch signal L are set to the active level at a timing immediately after feeding (time point t0) of power of the electronic timepiece 100 and a timing before generation of each driving pulse PX of the driving signal XA.

When the control signal Q is set to the active level, the specification data D according to a voltage of the setting terminal 36 is supplied to the latch unit 28. Specifically, in the first specification in which the setting terminal 36 is set to the power voltage VDD, the power voltage VDD is supplied as the specification data D to the latch unit 28. On the other hand, in the second specification in which the setting terminal 36 is set to the open state, the setting terminal 36 is set to the ground voltage VSS when the switch 342 transitions to the on state in accordance with the control signal Q. Accordingly, the ground voltage VSS is supplied as the specification data D to the latch unit 28. An operation in which the latch unit 28 latches the specification data D according to the latch signal L or operations of the signal output unit 30 and the driving unit 32 are the same as those of the first embodiment. In the second embodiment, the same advantages as those of the first embodiment are realized.

Third Embodiment

Figure 7:
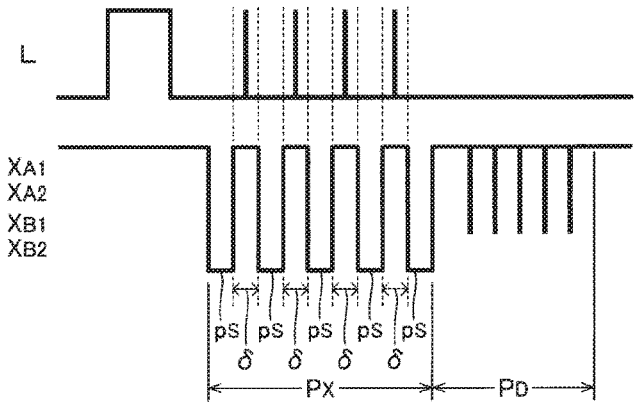
FIG. 7 is a diagram illustrating the waveforms of a driving pulse and a latch signal according to a third embodiment.

FIG. 7 is a diagram illustrating a relation between the latch signal L and the driving pulse PX according to a third embodiment. As exemplified in FIG. 7, driving pulses PX of driving signals (XA1, XA2, XB1, XB2) include a plurality of (five in the example of FIG. 7) sub-pulses pS. The latch signal L of the first embodiment is set to the active level before generation of the driving pulse PX and even during a period of the driving pulse PX. Specifically, the control unit 24 sets the latch signal L to the active level during each period δ between the sub-pulses pS occurring in succession. Accordingly, the specification data D output from the storage unit 26 is latched by the latch unit 28 even during each period δ between the sub-pulses pS besides before the generation of the driving pulse PX.

Even in the third embodiment, the same advantages as those of the first embodiment are realized. Incidentally, in the first and second embodiments, the specification data D may not be corrected up to before the generation of the immediately subsequent driving pulse PX in a case in which the specification data D output from the latch unit 28 to the signal output unit 30 abruptly varies at a time point during the course of the driving pulse PX. In contrast, in the third embodiment, the latch signal L is set to the active level within a period of the driving pulse PX. Accordingly, there is the advantage of quickly correcting the specification data D without waiting for the immediately subsequent driving pulse PX in a case in which the specification data D output from the latch unit 28 abruptly varies within the period of the driving pulse PX.

Fourth Embodiment

Figure 8:
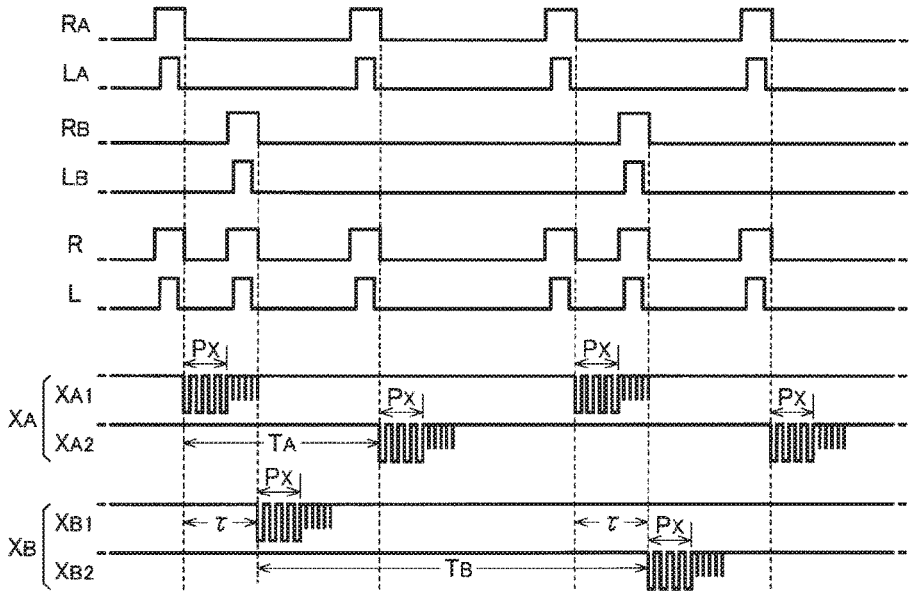
FIG. 8 is a diagram illustrating waveforms of signals used in an electronic timepiece according to a fourth embodiment.

FIG. 8 is a diagram illustrating waveforms of signals used in an electronic timepiece 100 according to a fourth embodiment. As exemplified in FIG. 8, in the fourth embodiment, the positions of the driving pulses PX are selected so that the driving pulses PX of the driving signals XA (XA1 and XA2) and the driving pulses PX of the driving signals XB (XB1 and XB2) do not overlap on the time axis. Specifically, the driving pulse PX of the driving signal XB occurs at a time point at which a time the driving pulse PX delays by a time τ with respect to the driving pulse PX of the driving signal XA.

As exemplified in FIG. 8, the control unit 24 according to the fourth embodiment generates the latch signal L and the read signal R (the control signal Q according to the second embodiment) so that the latch signal L and the read signal R have the active level at timings before generation of the driving pulses PX of the driving signals XA and XB. That is, the latch signal L and the read signal R are set to the active level at both timings before generation of the driving pulses PX of the driving signals XA1 and XA2 and timings before generation of the driving pulses PX of the driving signals XB1 and XB2.

Specifically, as exemplified in FIG. 8, the latch signal L is generated by logical sum of the latch signal LA having the active level before the generation of each driving pulse PX of the driving signal XA and the latch signal LB having the active level before the generation of each driving pulse PX of the driving signal XB. Similarly, the read signal R is generated by logical sum of the read signal RA having the active level before the generation of each driving pulse PX of the driving signal XA and the read signal RB having the active level before the generation of each driving pulse PX of the driving signal XB. As understood from the foregoing description, the specification data D is latched by the latch unit 28 before the generation of each driving pulse PX of both the driving signals XA and XB.

In the fourth embodiment, the same advantages as those of the first embodiment are realized. In the fourth embodiment, the latch signal L is set to the active level at the timings before the generation of the driving pulses PX of the driving signals XA and XB. That is, the abruptly varying specification data D is corrected immediately before the generation of the driving pulse PX. Accordingly, the above-described advantage of quickly correcting the specification data D abruptly varying due to the variation in the power voltage VDD is particularly noticeable.

In configuration for supplying the specification data D to the latch unit 28 in the third and fourth embodiments, either the configuration of the first embodiment in which the storage unit 26 is used or the configuration of the second embodiment in which the pull-down circuit 34 is used can be adopted.

Modification Examples

The above-described embodiments can be modified in various forms. Specific modification forms will be exemplified below. Two or more forms arbitrarily selected from the following examples can be appropriately merged within the scope of the invention in which the forms are not mutually contradicted.

Figure 9:
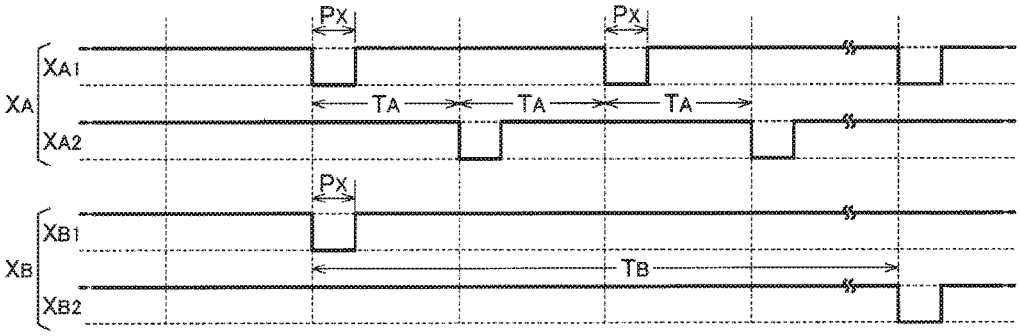
FIG. 9 is a diagram illustrating waveforms of signals used in an electronic timepiece according to a modification example.

(1) In the above-described embodiments, the driving pulses PX with the pectinate shape in which the plurality of sub-pulses pS are arranged have been exemplified, but the waveform of the driving pulse PX is not limited to the foregoing example. For example, as exemplified in FIG. 9, the driving pulse PX with a single rectangular wave can also be used.

(2) In the above-described embodiments, the configuration in which two kinds of driving signals XA and XB are selected according to the specification data D has been exemplified, but the number of kinds of signals which are candidates selected according to the specification data D is not limited to two kinds of signals. That is, any of three or more kinds of driving signals having different periods of the driving pulses PX can also be output according to the specification data D by the signal output unit 30. From the viewpoint that the abruptly varying specification data D is quickly corrected, it is proper for the control unit 24 to generate the latch signal L so that the latch signal has at least the active level at a timing before the generation of each driving pulse PX of the driving signal (in the above-described, the driving signal XA) with the shortest period of the driving pulse PX among the plurality of driving signals.

(3) In the above-described embodiments, the configuration in which the selection unit 46 selects either the driving signal XA generated by the signal generation unit 42 or the driving signal XB generated by the signal generation unit 44 has been exemplified, but a configuration in which either the driving signal XA or the driving signal XB is selectively output is not limited to the above example. For example, it is possible that either the driving signal XA or the driving signal XB is selectively generated according to the specification data D. Specifically, in a case in which the specification data D designates the first specification, the driving signal XA is generated by the signal generation unit 42 whereas the generation of the driving signal XB by the signal generation unit 44 is stopped. On the other hand, in a case in which the specification data D designates the second specification, the generation of the driving signal XA by the signal generation unit 42 is stopped whereas the driving signal XB is generated by the signal generation unit 44. In the foregoing configuration, the selection unit 46 is not necessary. As understood from the foregoing example, the signal output unit 30 in each of the above-described embodiments is inclusively expressed as an element to output one of the plurality of driving signals (XA and XB) based on the specification data D, and therefore the plurality of driving signals may be actually generated, and one driving signal may be selectively output or any of the plurality of driving signals may be selectively generated.

The entire disclosure of Japanese Patent Application No. 2016-057826, filed Mar. 23, 2016 is expressly incorporated by reference herein.

What is claimed is:

1. An electronic timepiece comprising:

a control unit that generates a latch signal and a criterion signal;

a latch unit that latches and outputs specification data designating a specification in accordance with the latch signal;

a signal output unit that (i) receives a plurality of driving signals in accordance with the criterion signal as received from the control unit and (ii) selectively outputs, from among the plurality of driving signals, one of the plurality of driving signals including driving pulses at different periods based on the specification data output from the latch unit; and a driving unit that drives a motor based on the driving signal output from the signal output unit; and wherein the control unit generates the latch signal so that the latch signal has at least an active level at a timing before generation of each driving pulse of the driving signal with a shortest period of the driving pulse among the plurality of driving signals.

2. The electronic timepiece according to claim 1, further comprising:

a storage unit that stores the specification data, wherein the latch unit latches the specification data read from the storage unit.

3. The electronic timepiece according to claim 1, further comprising:

a setting terminal with which one of a plurality of voltages is supplied, wherein the latch unit latches and outputs the specification data according to the voltage of the setting terminal in accordance with the latch signal.

4. The electronic timepiece according to claim 1, wherein the driving pulse includes a plurality of sub-pulses, and wherein the control unit sets the latch signal to the active level during a period of the sub-pulses occurring in succession.

5. The electronic timepiece according to claim 1, wherein the control unit generates the latch signal so that the latch signal has the active level at a timing before generation of the driving pulses of each of the plurality of driving signals.

* * * * *